US007617806B2

(12) United States Patent
Schmidt et al.

(10) Patent No.: US 7,617,806 B2
(45) **Date of Patent: *Nov. 17, 2009**

(54) VALVE DRIVE OF AN INTERNAL COMBUSTION ENGINE

(75) Inventors: Volker Schmidt, Burgbernheim (DE); Michael Berger, Erlangen (DE)

(73) Assignee: Schaeffler KG, Herzogenaurach (DE)

( * ) Notice: Subject to any disclaimer, the term of this patent is extended or adjusted under 35 U.S.C. 154(b) by 221 days.

This patent is subject to a terminal disclaimer.

(21) Appl. No.: 11/718,667

(22) PCT Filed: Oct. 12, 2005

(86) PCT No.: PCT/EP2005/010945

§ 371 (c)(1),
(2), (4) Date: Jun. 28, 2007

(87) PCT Pub. No.: WO2006/048101

PCT Pub. Date: May 11, 2006

(65) Prior Publication Data

US 2009/0056653 A1 Mar. 5, 2009

(30) Foreign Application Priority Data

Nov. 4, 2004 (DE) ..... 10 2004 053 202

(51) Int. Cl.
*F01L 1/34* (2006.01)

(52) U.S. Cl. ..... 123/90.16; 123/90.12; 123/90.44

(58) Field of Classification Search ..... 123/90.16, 123/90.2, 90.39, 90.44, 90.45, 90.46, 90.27, 123/90.31, 90.12, 90.13, 90.48, 90.55
See application file for complete search history.

(56) References Cited

U.S. PATENT DOCUMENTS

| | | | | |
|---|---|---|---|---|
| 2,614,547 | A | 10/1952 | Meinecke | |
| 4,977,867 | A | 12/1990 | Rhoads | |
| 5,113,811 | A | 5/1992 | Rembold et al. | |
| 5,161,500 | A * | 11/1992 | Kubis et al. | 123/321 |
| 7,325,522 | B2 * | 2/2008 | Schmidt | 123/90.27 |

FOREIGN PATENT DOCUMENTS

| | | |
|---|---|---|
| DE | 4102537 | 7/1992 |
| DE | 4225012 | 7/1993 |
| DE | 4318293 | 12/1993 |
| DE | 4324837 | 1/1995 |
| DE | 10156309 | 7/2002 |
| JP | 63297710 A * | 12/1988 |
| JP | 07042519 | 2/1995 |

* cited by examiner

*Primary Examiner*—Ching Chang
(74) *Attorney, Agent, or Firm*—Volpe and Koenig, P.C.

(57) ABSTRACT

A valve drive (1) of an internal combustion engine which is used to actuate a gas exchange valve (6) is provided. Displacement of the valve takes place when a cam (9) is lifted and when a hydraulic force applying device (12) is lifted. A piston (13) of the force applying device can be displaced from a first end position (A) to a second end position by feeding a hydraulic medium, which can be pressure-adjusted, from a hydraulic medium line (24) into a pressure chamber (21). The pressure chamber (21) can be connected to the hydraulic medium line (24) via a shut-off element (20) which is open towards the pressure chamber (21) and which is arranged in the housing (15) and also by means of at least one passage (26) in the housing (15). The passage (26) is at least partially blocked by an external casing surface (16) of the piston (13) in the first end position (A) thereof.

12 Claims, 4 Drawing Sheets

VALVE DRIVE OF AN INTERNAL COMBUSTION ENGINE

BACKGROUND

The invention relates to a valve drive of an internal combustion engine for actuating a gas-exchange valve. Its motion follows the lift of a cam and also the lift of a hydraulic force-applying device superimposed on and independent of the lift of the cam. For this purpose, a piston of the force-applying device can move relative to a housing of the force-applying device from a first end position to a second end position in a pressure chamber formed by the piston and the housing through timed-variable feeding of a pressure-adjustable hydraulic medium from a hydraulic medium line.

Valve drives according to this class, in which the lift of the gas-exchange valve is comprised of superimposing a lift originating from the cam and a variable, adjustable lift of a hydraulic force-applying device, which acts on the motion of the gas-exchange valve independent of the cam, are known in the state of the art. For example, DE 101 56 309 A1 describes a cup-tappet valve drive with a hydraulic force-applying device. This is used to superimpose a lift generated by the cam on a lift of the gas-exchange valve independent of the cam. For this purpose, between the inside of the cup base and the valve shaft there is a pressure piston, whose relative motion relative to the cup tappet is generated through a volume change of a pressure chamber bordering the pressure piston. The pressure chamber is connected, on one side, via channels in the interior of the cup tappet and also in the tappet guide of the internal combustion engine to a hydraulic medium supply that is adjustable in pressure or volume flow.

In DE 43 18 293 A1, also according to this class, a finger lever drive with a pivot support is proposed, whose bearing point for the finger lever can be lowered by regulating the hydraulic medium out of the pressure chamber of the force-applying device by means of a control valve. By lowering the bearing point, the cam lift is sub-divided kinematically onto the bearing point and the gas-exchange valve, which reduces the lift transmitted to the gas-exchange valve.

Although with the previously mentioned valve drive an essentially variable influence of the valve lift originating from the cam is already possible, wherein partially also means for braking the piston motion are provided for reaching the end positions, the previously known systems have a few disadvantages. For example, the piston of DE 101 56 309 A1 is embodied as a stepped piston, which forces hydraulic medium from an annular space located on the cup bottom with a cylindrical annular section. For reaching the end position, the piston is here braked by forcing the hydraulic medium out of the annular space via guide gaps between the annular section and annular space. Such a construction, however, requires the double fitting of the components, resulting in the hydraulic force-applying device being associated with considerable production and quality-assurance expense and consequently high manufacturing costs. Moreover, the piston is then prevented from leaving the end position at a high acceleration and thus as quickly as possible, because the annular space first must be refilled with hydraulic medium via the narrow guide gaps.

In DE 43 18 293 A1, a ball check valve is located between the housing of the pivot support and the hydraulic medium supply. This is arranged, however, in the cylinder head of the internal combustion engine in a way that is not easy to assemble and is also limited in throughput according to principle. In this respect, here a high acceleration of the piston can be realized only to a limited extent when it leaves its end position.

In the two publications noted above, the braking profile of the piston when reaching the end position dependent on the viscosity and thus, in particular, on the temperature of the hydraulic medium, is further to be viewed as disadvantageous. Both forcing the hydraulic medium via annular gaps, as provided in DE 101 56 309 A1, and also connecting the pressure chamber to a relatively long choke line according to DE 43 18 293 A1 leads to a considerable dependency of the braking profile on the viscosity of the hydraulic medium. This dependency, however, is in no way desired. In addition, the very wide operating temperature span of the internal combustion engine would lead to extremely different braking profiles of the piston, which could be equalized only with high electro-hydraulic control expense.

SUMMARY

Therefore, the present invention is based on the objective of improving a valve drive of the type noted above, such that the described disadvantages are avoided. The pressure chamber should be equipped with a hydraulically active device, which enables both a targeted braking profile of the piston and also a profile that is as independent as possible from the viscosity of the hydraulic medium when reaching the end position. Simultaneously, a quick acceleration of the piston when leaving the end position should be able to be realized. The valve drive should be able to be produced in a simple way and cost-effectively under mass-production conditions.

This objective is met with the features of the invention, while advantageous improvements and constructions can be found in the following description.

Consequently, the objective is met in that the pressure chamber is connected both to the hydraulic medium line via a blocking means arranged in the housing and opening to the pressure chamber and also via at least one passage in the housing. In this way, the passage is at least partially blocked in its first end position due to overlapping by an outer casing surface of the piston.

The subject matter of the present invention is a valve drive that can be produced economically and that allows the lift of a cam and a lift of a hydraulic force-applying device independent of the lift of the cam to be superimposed on the gas-exchange valve. Here, the motion profile of the piston when reaching and leaving the first end position is the deciding factor for the quality of the valve-drive function. When reaching the first end position, the goal is that the motion of the piston is abruptly braked from a high to a low speed, in order to simultaneously guarantee a soft placement of the gas-exchange valve into its valve seat. The hydraulic force-applying device should also be able to generate lifting of gas-exchange valves with a large time cross section, for which a high speed of the piston between the first and the second end position is necessary.

A preferred construction of the valve drive is provided according to the invention, in which the pressure chamber is connected to the hydraulic medium line both via the passage and also via a choke cross section. Here, the choke cross section should be constructed essentially like a diaphragm. Such a choke cross section generates a braking profile of the piston that is largely independent of the viscosity of the hydraulic medium and that is sufficiently uniform over the operating temperature of the internal combustion engine, while the passage can consequently be designed for quick emptying and filling of the pressure chamber.

In an especially preferred construction according to the invention, the valve drive according to the invention provides a hydraulic valve play compensating device, which is arranged in a hollow cylindrical recess of the piston. In this way, it is possible both to minimize the control time fluctuations of the internal combustion engine due to mechanical valve play and also to synchronize the motion of the piston with that of the gas-exchange valve. This synchronization considerably aids a uniform braking profile of the piston. Conversely, a large mechanical valve play could lead to the result that the piston would not be braked in due time and consequently the gas-exchange valve would impact its valve seat with impermissibly high speed, resulting in valve noise and wear.

According to another embodiment, it is advantageous to define the second end position of the piston by contact means. In this way, overshooting of the piston past the second end position, as can happen for an error function of the valve drive, for example, due to too high a pressure in the hydraulic medium line, can be effectively prevented. Second, the piston is secured from falling out of the housing in the not yet mounted state of the valve drive.

As an addition or alternative to this stopping means, the pressure chamber according to the invention can also be emptied via a discharge line for the hydraulic medium when the piston reaches the second end position. For this purpose, in the housing there is at least one outlet opening, which is at most partially blocked by the outer casing surface of the piston when reaching the second end position and which thus connects the pressure chamber to the discharge line.

An advantage in this construction is, on one hand, reduced mechanical loading of the stopping means and, on the other hand, the possibility of flushing stiffness-reducing gas bubbles in the hydraulic medium out of the pressure chamber.

According to the invention, it is advantageous when the blocking means is a ball check valve. Such ball check valves have proven very effective in practice and can be manufactured economically.

An especially preferred construction of the valve drive provides that the piston is arranged in a pivot support, which pivotably supports a finger lever. For this purpose, a compensating piston supporting the finger lever is guided in the hydraulic valve play compensating device so that it can move longitudinally in the piston. Here, it is useful according to claim 8 to integrate a rotatably supported roller in the finger lever as a low-friction contact surface to the cam.

According to another embodiment, the valve drive should also allow a secondary lift of the gas-exchange valve during a lift-free base-circle phase of the cam. This produces advantageous possibilities for recirculating exhaust gas internally in large and precisely adjustable quantities. This form of exhaust gas recirculation is the basis, in particular, for an operation of the internal combustion engine for homogeneous and self-igniting charging. Such a combustion process, which is also designated as the HCCI process (Homogeneous Charge Compression Ignition) can be used both for self-ignited diesel combustion engines and also for externally ignited Otto combustion engines at least in the partial load operation of the internal combustion engine mainly for the purpose of reducing emissions. The combustion sequence is set in the HCCI process essentially through the control of the charge composition and the charge temperature profile. For this combustion process, it has been shown that a high charge temperature is desired for controlling the ignition time. A very effective means for increasing the charge temperature is increasing the residual gas content, i.e., increasing the content of non-flushed exhaust gas or flushed exhaust gas recirculated back into the cylinder from the preceding combustion cycle into the cylinder charging for the next combustion cycle. Here, the residual gas content must be able to be adapted completely variably to the operating point of the internal combustion engine, wherein residual gas percentages of 60% of the cylinder charge and more can be necessary. Residual gas percentages at this level can no longer be provided by means of internal exhaust gas recirculation through conventional valve overlapping or by means of a device for external exhaust gas recirculation. Moreover, the HCCI process reacts with unacceptable combustion sequences in an extremely sensitive way to changes in the charging properties, so that, in addition to providing residual gas in the necessary amount, a combustion cycle-consistent, highly precise, and cylinder-specific dosing of the residual-gas percentage is also necessary.

The secondary lift happens according in one preferred embodiment on an exhaust valve, in the case of the exhaust gas recirculation explained above, exhaust gas already displaced into the exhaust channel is recirculated into the combustion chamber via the then still opened exhaust valve during the suction cycle of the internal combustion engine. In contrast, however, there is also the possibility to operate the valve drive according to the invention as an engine brake, in particular, for air-compressing internal combustion engines as a safety-related expansion of the operating brake. Such engine braking is typically used for long-duration braking in commercial vehicles and is based on the principle that the drag moment of the internal combustion engine in engine-braking and coasting mode can be considerably increased by increasing the charge changing work and the vehicle is therefore braked. In this case, the exhaust valve is still open during the compression phase, so that the cylinder charge is not compressed like pneumatic spring action, but instead is pushed into the exhaust channel under the application of the displacement work.

In terms of the exhaust gas recirculation, however, it can also be useful that the secondary lift takes place on an inlet valve. In this alternative construction, exhaust gas is displaced into the inlet channel in the thrust cycle of the internal combustion engine for a still open inlet valve and recirculated into the combustion chamber during the suction cycle.

A combination of these previously mentioned possibilities of exhaust gas recirculation is also possible. Accordingly, for setting the quantity and temperature of the residual gas it can be advantageous to recirculate exhaust gas both from the inlet channel and also from the outlet channel.

For the sake of simplicity, in one preferred embodiment the lubricating oil of the internal combustion engine is used as the hydraulic medium. In contrast, however, the use of any other suitable fluid in a hydraulic medium circuit, which would then be separated from the lubricating oil circuit of the internal combustion engine, is also conceivable.

BRIEF DESCRIPTION OF THE DRAWINGS

Additional features of the invention emerge from the following description and from the drawings, in which a finger lever drive is shown as an embodiment of the valve drive according to the invention. Shown are.

DETAILED DESCRIPTION OF THE PREFERRED EMBODIMENTS

Figure 1:
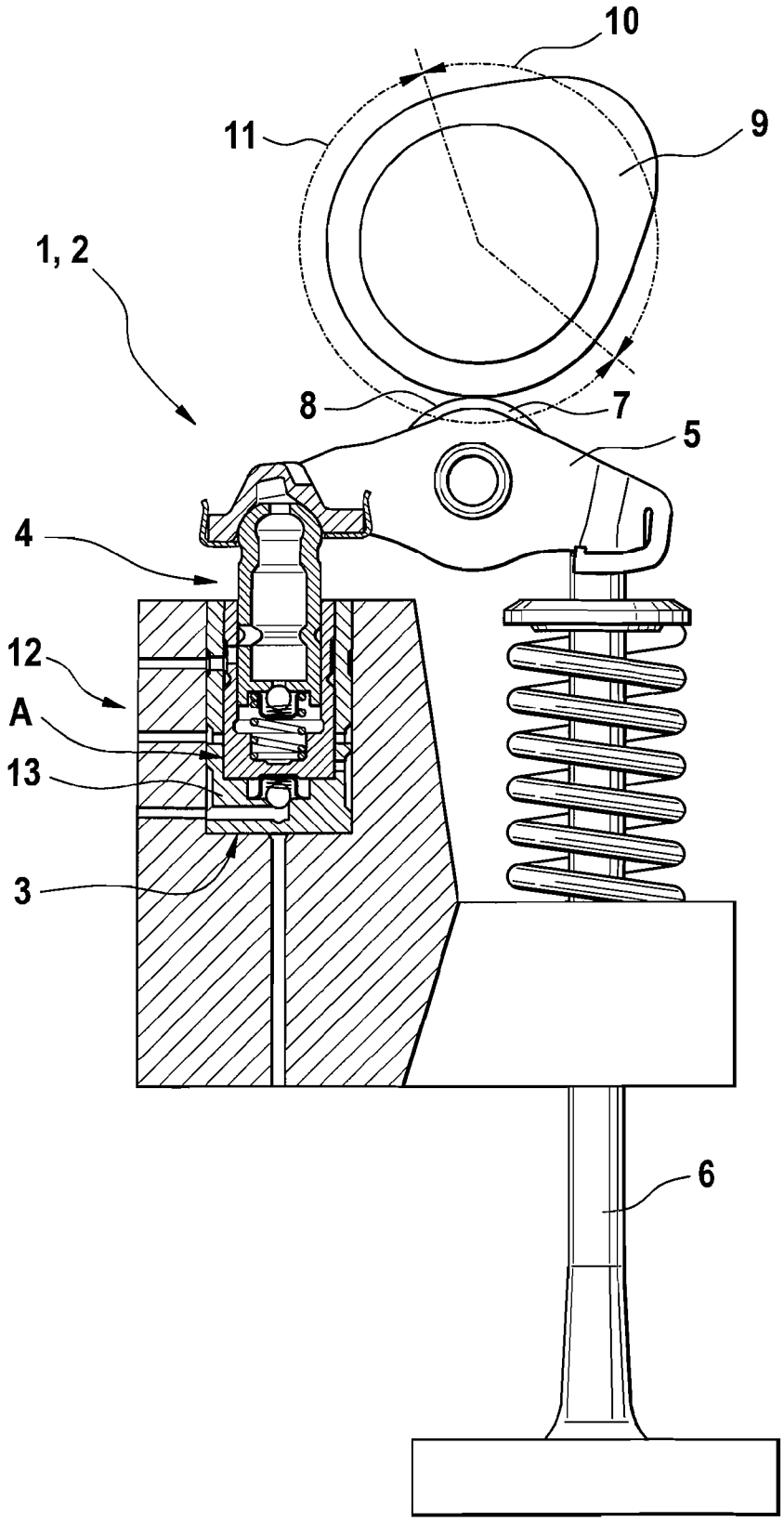
FIG. 1 a view of the finger lever drive for a closed gas-exchange valve with a longitudinally sectioned pivot support, FIG. 2 an enlarged view of the pivot support according to FIG. 1, FIG. 3 a view of the finger lever drive according to FIG. 1 for an opened gas-exchange valve, FIG. 4 an enlarged view of the pivot support according to FIG. 3.

In FIGS. 1 to 4, the valve drive 1 according to the invention is disclosed using the example of a finger lever drive 2 for an internal combustion engine. As shown in FIG. 1, a pivot support 4, which supports a finger lever 5 so that it can pivot in the actuation direction of a gas-exchange valve 6, is located in a hollow cylindrical recess 3 of the internal combustion engine. A roller 7 supported in the finger lever 5 so that it can rotate is used as a low-friction contact surface 8 to a cam 9. The cam 9 has a cam lifting phase 10, which generates a lift on the gas-exchange valve 6, and a lift-free base-circle phase 11.

Figure 2:
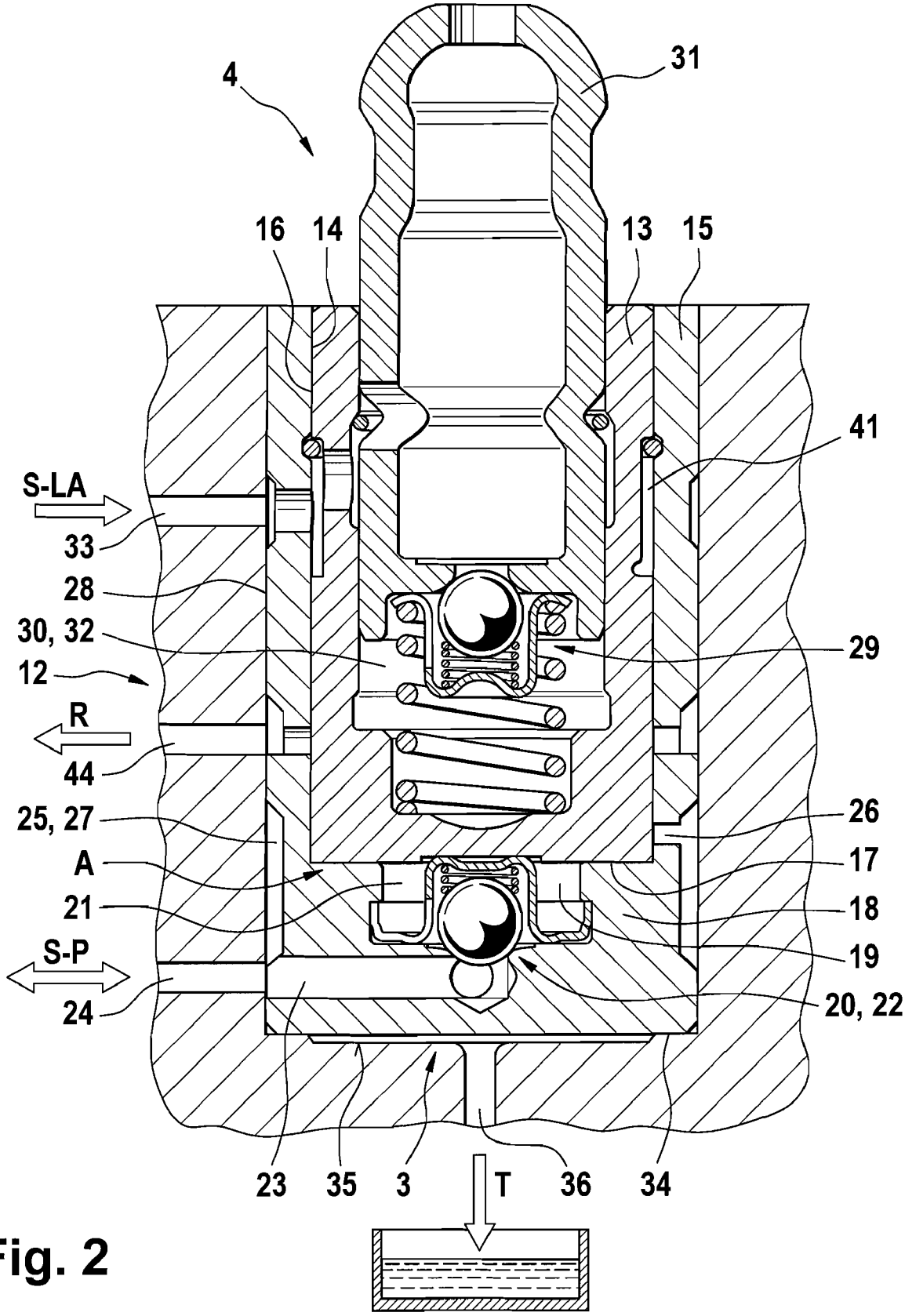

The pivot support 4 is a component of a hydraulic force-applying device 12 and is shown in FIG. 1 and also enlarged in FIG. 2 for a first end position "A" of a piston 13. The gas-exchange valve 6 is closed here, because the cam 9 simultaneously contacts the roller 7 with its base-circle phase 11.

The piston 13 is guided longitudinally with an outer casing surface 16 in an inner casing surface 14 of a pot-shaped housing 15. In the first end position "A" an end surface 17 of the piston 13 contacts a base 18 of the housing 15. The base 18 has a depression 19 for receiving a blocking means 20 for a pressure chamber 21, which is located within the housing 15 and which is limited by the end surface 17 of the piston 13. The blocking means 20 is constructed in this embodiment as a ball check valve 22, which opens towards the pressure chamber 21 and creates a hydraulic connection between at least one channel 23 arranged in the base 18 of the housing 15 and also the pressure chamber 21.

On its side, the channel 23 is in hydraulic connection with a hydraulic medium line 24 opening into the recess 3. This is also a component of the hydraulic force-applying device 12 and is used for supplying the pressure chamber 21 with hydraulic medium, whose pressure is adjustable via a schematically illustrated hydraulic control device "S-P".

Through another feed line 25 communicating with the hydraulic medium line 24, there is also a connection to the pressure chamber 21 via one or more passages 26 opening into the inner casing surface 14 of the housing 15. Here, the passages 26 in the first end position "A" of the piston 13 are partially or completely blocked by the outer casing surface 16 of the piston 13. The feed line 25 is preferably shaped so that an annular groove 27 in the outer casing surface 28 of the housing 15 is allocated to the hydraulic medium line 24, wherein the channel 23 leading to the ball check valve 22 also forms an outlet from the annular groove 27. Alternatively, it can obviously also be provided to arrange an annular groove with an identical function in the recess 3.

The pivot support 4 provides in the illustrated embodiment a hydraulic valve play compensating device 29, which is arranged in a hollow cylindrical recess 30 of the piston 13 and which has, in a known way, a compensating piston 31 supporting the finger lever 5 and a work chamber 32, to which is allocated a hydraulic medium supply "S-LA" via a supply line 33.

In order to avoid an undesired spacing of one end side 34 of the housing 15 facing away from the finger lever 5 to a base 35 of the recess 3 due to hydraulic medium blocked in-between, the base 35 is connected via a balancing line 36 to a no-pressure or low-pressure reservoir "T". Through the pressure-balancing effect of the balancing line 36, it is unnecessary to secure the housing 15 against undesired longitudinal movement due to blocked hydraulic medium in the recess 3 of the internal combustion engine.

Figure 3:
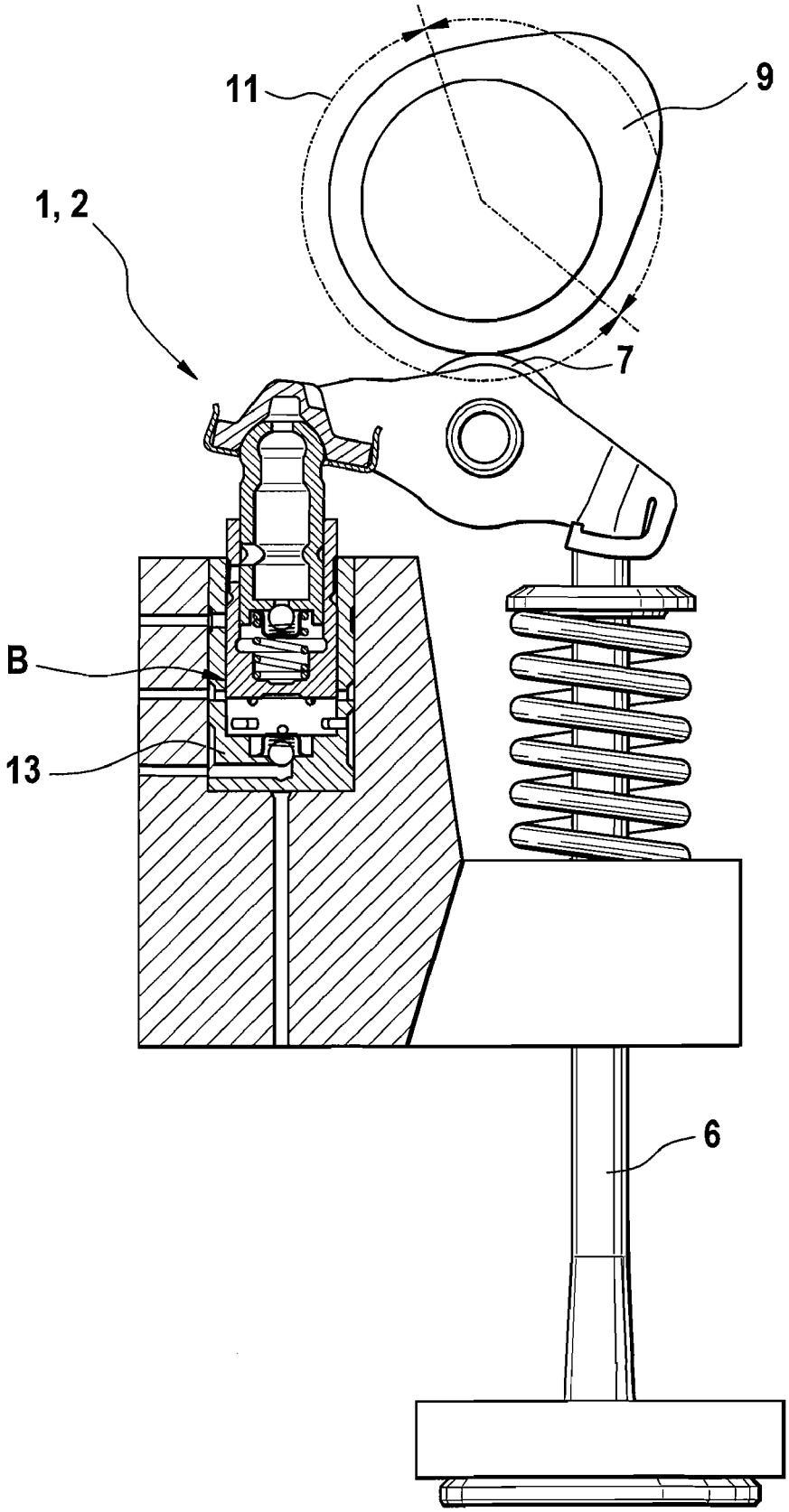
Figure 4:
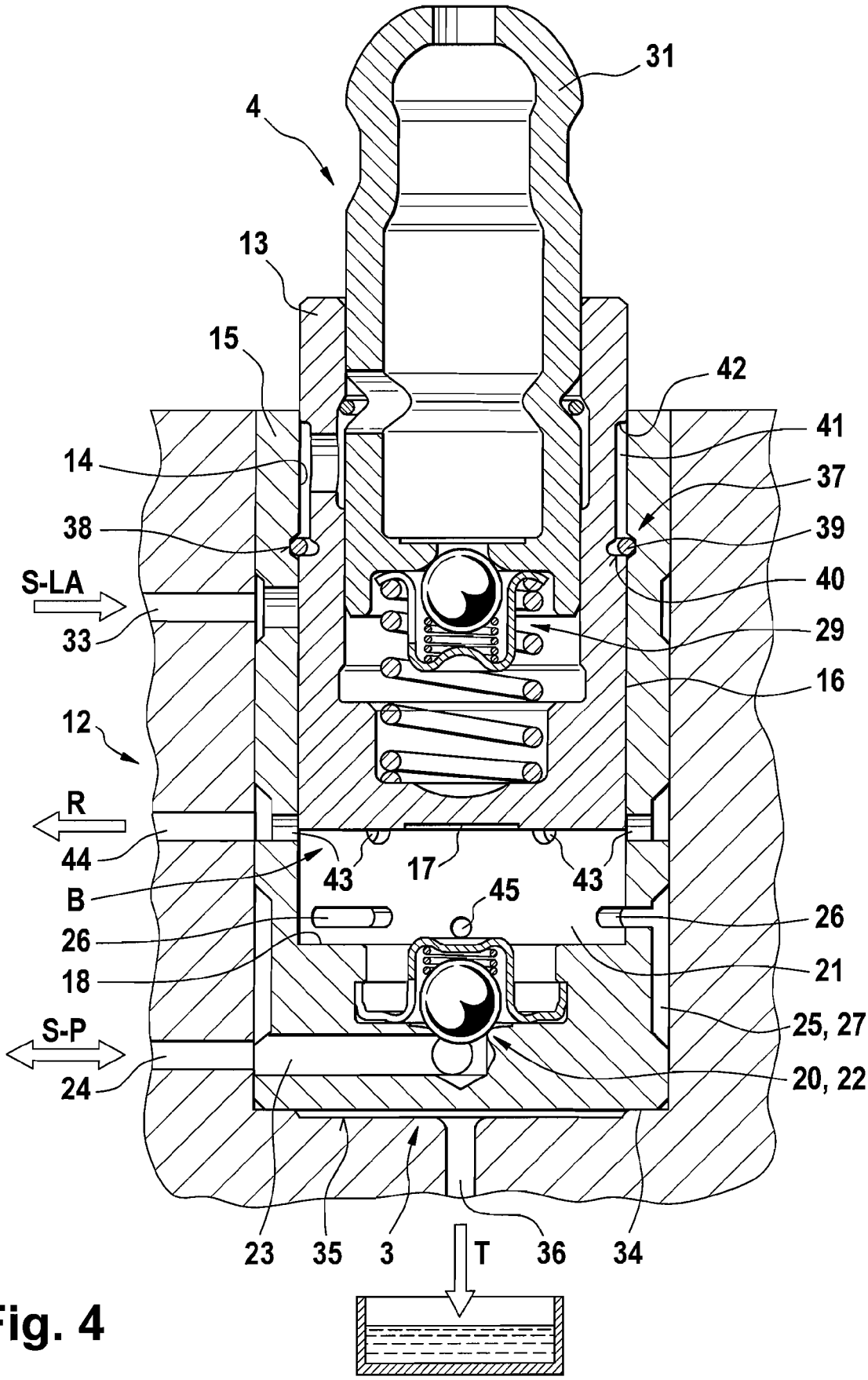

In FIGS. 3 and 4, the piston 13 is located in a second end position "B" and the gas-exchange valve 6 is opened, wherein the cam 9 still contacts the roller 7 with its base-circle phase 11. The movement of the piston 13 from the first end position "A" into the second end position "B" is described in the following with reference to FIG. 4. The piston 13 leaves the first end position "A" with high acceleration, in that initially a main volume flow of pressurized hydraulic medium is led from the hydraulic medium line 24 via the channel 23 for an opened ball check valve 22 into the pressure chamber 21. For the further movement of the piston 13, the passages 26 are released successively from the outer casing surface 16 of the piston 13, so that the hydraulic medium can then be led with low resistance via the ball check valve 22 and simultaneously via the feed line 25 and via the passages 26 into the pressure chamber 21. The low-resistance feeding of the hydraulic medium into the pressure chamber 21 generates a high velocity of the piston 13, so that the second end position "B" is reached in a short time. This is especially advantageous for high rotational speeds of the internal combustion engine, in order to also then realize a large time cross section of the lift on the gas-exchange valve 6 generated by the hydraulic force-applying device 12.

The piston 13 is braked again to a standstill in the area of the second end position "B" by stopping means 37. As an example for such stopping means 37, an annular body 39, whose inner diameter is smaller than that of the inner casing surface 14 of the housing 15, is placed in a recess 38 of the housing 15. Overshooting the second end position "B" of the piston 13 is prevented in that a lower shoulder 40 of an annular groove 41 of the piston 13 contacts the annular body 39. The annular groove 41 is here shaped with sufficient width so that reaching the first end position "A" is not prevented by contact of an upper shoulder 42 of the annular groove 41 with the annular body 39. An inverse arrangement is also conceivable as a not-shown variant of an identically functioning stopping means.

In this way, an annular body in an outer recess of the piston 13 would move with the piston 13 and would stop in the second end position "B" against a shoulder of an annular groove located in the housing 15.

Alternatively or additionally, hydraulic braking of the piston 13 is also possible, in that the outer casing surface 16 of the piston 13 exposes one or more outlet openings 43, which connect a discharge line 44 acting as a return line "R" to the pressure chamber 21, in the area of the second end position "B". The piston 13 in this case automatically regulates its second end position "B", in that it opens the outlet openings 43 so far that the hydraulic medium volume fed into the pressure chamber 21 corresponds to the hydraulic medium volume discharged from the pressure chamber 21 into the discharge line 44.

At this point it should be explicitly mentioned that the variability of the hydraulic force-applying device in terms of the lift of the piston 13 is not limited in that the piston 13 must reach the second end position "B". Instead, through suitable control of the hydraulic control device "S-P" it is possible that the piston 13 comes to a standstill in any arbitrary position between the first end position "A" and the second end position "B", in order to then return to the end position "A" as described below.

Return motion of the piston 13 in the direction of the first end position "A" begins when the hydraulic control device "S-P" permits a discharge of the hydraulic medium from the pressure chamber 21. The discharge of the hydraulic medium takes place—optionally after closing the outlet openings 43—only via the passages 26 and the feed line 25 into the hydraulic medium line 24, because the ball check valve 22 to the channel 23 is now closed. Shortly before reaching the first end position "A" the piston 13 is braked, in that its outer casing surface 16 successively closes the passages 26. A soft placement of the end surface 17 of the piston 13 onto the base 18 of the housing 15 can be guaranteed, in that at least one of the passages 26 is not completely blocked in the first end position "A" and only a small volume flow of the hydraulic medium can escape from the pressure chamber 21 with a correspondingly reduced velocity of the piston 13.

A preferred alternative is provided by the possibility of connecting the pressure chamber 21 to the feed line 25 via a diaphragm-like choke cross section 45. With the help of such a choke cross section 45, a braking profile of the piston 13 largely independent of the viscosity of the hydraulic medium can be guaranteed when reaching the first end position "A". So that the braking effect of the choke cross section 45 unfolds in an optimal way, it is useful to already completely close the passages 26 before reaching the first end position "A" by the outer casing surface 16 of the piston 13.

The valve drive 1 according to the invention was explained using the example of a finger lever valve drive 2 with a pivot support 4 as a preferred embodiment. The concept according to the invention, however, can be equally transferred to other valve drive constructions, for example, for cup tappet drives or tappet push rod drives. Furthermore, valve drives that have a switchable arrangement through coupling means should also be included within the protective scope of the invention, in order to transfer lifts of several cams selectively to the gas-exchange valve 6 as a function of the coupling state. This applies equally for valve drives, which continuously vary the lift of the gas-exchange valve 6 by means of a cam and additional adjustment elements.

List of reference numbers and symbols

1 Valve drive
2 Finger lever drive
3 Recess
4 Pivot support
5 Finger lever
6 Gas-exchange valve
7 Roller
8 Contact surface
9 Cam
10 Cam lifting phase
11 Base-circle phase
12 Force-applying device
13 Piston
14 Inner casing surface
15 Housing
16 Outer casing surface
17 End surface
18 Base
19 Depression
20 Blocking means
21 Pressure chamber
22 Ball check valve
23 Channel
24 Hydraulic medium line
25 Feed line
26 Passage
27 Annular groove
28 Outer casing surface
29 Valve play compensating device
30 Recess
31 Compensating piston
32 Working chamber
33 Supply line
34 End side
35 Base
36 Balancing line
37 Stopping means
38 Recess
39 Annular body
40 Lower shoulder
41 Annular groove
42 Upper shoulder
43 Outlet opening
44 Discharge line
45 Choke cross section
A First end position
B Second end position
S-P Control device
S-LA Hydraulic medium supply
T Reservoir
R Return

The invention claimed is:

1. A valve drive of an internal combustion engine for actuating a gas-exchange valve, whose movement follows a lift of a cam, comprising a hydraulic force-applying device having a lift which is superimposed on the lift of the cam and which is independent of the lift of the cam, the force-applying device including a piston that can move relative to a housing of the force-applying device from a first end position in which the gas-exchange valve is closed to a second end position in which the gas-exchange is opened through a time variable feed of a pressure-adjustable hydraulic medium from a hydraulic medium line into a pressure chamber formed by the piston and the housing, the pressure chamber is connected to the hydraulic medium line via blocking means arranged in the housing and opening into the pressure chamber and also via at least one separate passage in the housing leading from the hydraulic medium line to the pressure chamber, and the at least one passage is at least partially blocked by the piston in the first end position due to overlapping by an outer casing surface of the piston.

2. The valve drive according to claim 1, wherein the pressure chamber is also connected to the hydraulic medium line via at least one choke cross section, wherein the choke cross section has a generally diaphragm-like construction.

3. The valve drive according to claim 1, wherein the piston has a hollow cylindrical recess, in which a hydraulic valve play compensating device is arranged.

4. The valve drive according to claim 3, wherein the piston is arranged in a pivot support, which supports a finger lever so that it can pivot on a compensating piston of a hydraulic valve play compensating device guided so that it can move longitudinally in the piston.

5. The valve drive according to claim 4, wherein a rotatably supported roller is integrated in the finger lever as a contact surface to the cam.

6. The valve drive according to claim 1, wherein the second end position of the piston is defined by a stop.

7. The valve drive according to claim 1, wherein the housing provides at least one outlet opening, which connects the pressure chamber to a discharge line for the hydraulic medium, when the at least one outlet opening is at most partially blocked in the second end position of the piston due to overlapping by the outer casing surface of the piston.

8. The valve drive according to claim 1, wherein the blocking means is a ball check valve.

9. The valve drive according to claim 1, wherein the gas-exchange valve executes at least one secondary lift during a base-circle phase of the cam.

10. The valve drive according to claim 9, wherein the gas-exchange valve is an exhaust valve of the internal combustion engine.

11. The valve drive according to claim 9, wherein the gas-exchange valve is an intake valve of the internal combustion engine.

12. The valve drive according to claim 1, wherein the hydraulic medium is lubricating oil of the internal combustion engine.

* * * * *